US006049261A

United States Patent [19]

Thomson

[11] Patent Number: 6,049,261

[45] Date of Patent: Apr. 11, 2000

[54] COLLAPSIBLE POCKET FOR CHANGING THE OPERATING FREQUENCY OF A MICROWAVE FILTER AND A FILTER USING THE DEVICE

[75] Inventor: R. Glenn Thomson, Waterloo, Canada

[73] Assignee: Com Dev Ltd., Cambridge, Canada

[21] Appl. No.: 09/082,911

[22] Filed: May 22, 1998

[30] Foreign Application Priority Data

Dec. 12, 1997 [CA] Canada ..... 2217924

[51] Int. Cl.[7] ..... H01P 1/208; H01P 7/06

[52] U.S. Cl. ..... 333/209; 333/232; 333/235

[58] Field of Search ..... 333/202, 208, 333/209, 219.1, 229, 234, 235, 232, 233, 231

[56] References Cited

U.S. PATENT DOCUMENTS

| | | | |
|---|---|---|---|
| 2,103,515 | 12/1937 | Conklin et al. | 333/234 |
| 4,521,754 | 6/1985 | Ranghelli et al. | 333/234 X |
| 4,675,630 | 6/1987 | Tang et al. | 333/208 |

FOREIGN PATENT DOCUMENTS

| | | | |
|---|---|---|---|
| 59-163840 | 9/1984 | Japan | 333/235 |
| 62-294301 | 12/1987 | Japan | 333/202 |
| 2-219303 | 8/1990 | Japan | 333/235 |
| 6-6120 | 1/1994 | Japan | 333/235 |

*Primary Examiner*—Seungsook Ham
*Attorney, Agent, or Firm*—Daryl W. Schnurr

[57] ABSTRACT

A device for changing the operating frequency of a microwave filter is mounted in a wall of a cavity of the filter. The device has a bellows that is located inside the cavity. The bellows contains an elongated member that extends outside the cavity to an actuator. The actuator can be temperature dependent and moves the elongated member either further into or further out of the cavity as desired. An interior end of the elongated member can be connected to the bellows or it can simply be in contact with the bellows without being connected. When the elongated member is in contact with the bellows and is not connected, when the elongated member moves outward, the bellows will return to a rest position due to its inherent spring. The bellows is sealed from an interior of the cavity. Filters using the device have one device located primarily for each mode in each cavity of the filter.

25 Claims, 5 Drawing Sheets

COLLAPSIBLE POCKET FOR CHANGING THE OPERATING FREQUENCY OF A MICROWAVE FILTER AND A FILTER USING THE DEVICE

BACKGROUND OF THE INVENTION

1. Field of the Invention

This invention relates to a device for changing an operating frequency of a microwave filter, said device being mounted in a wall of each cavity of a filter. The change in frequency can occur in response to temperature changes, thereby resulting in a temperature compensation microwave filter.

When a higher coefficient of thermal expansion is referred to in this specification, "higher" shall be interpreted to mean more positive (since coefficients of thermal expansion can be negative). Similarly, lower coefficients of thermal expansion means less positive. Similar terms have corresponding meanings.

2. Description of the Prior Art

It is known that temperature compensated filters can be compensated using irises made from bimetal materials (see Collins, et al., U.S. Pat. No. 4,488,132 issued Dec. 11, 1984; Atia, et al., U.S. Pat. No. 4,156,860 issued May 29, 1979 and Kick U.S. Pat. No. 4,677,403 issued Jun. 30, 1987). Temperature compensated filters that use bimetal end walls can be more complex to design than other temperature compensated filters. Further, in Japanese Patent No. 5-259719 (A) issued on Oct. 8, 1993, an adjustment screw made from dielectric material is provided with a hollow metallic thread. The dielectric body is fitted into the hollow thread. The dielectric screw penetrates into the cavity to compensate for changes in the cavity resonant frequency with temperature. The dielectric constant of the screw changes with temperature in such a fashion as to oppose changes in cavity resonant frequency that occur with temperature changes. The use of a dielectric screw can degrade the electrical performance of the filter.

A center frequency of a microwave filter changes as the operating temperature changes due to the expansion of materials with temperature. Filters are usually constructed of materials having a low coefficient of thermal expansion such as Invar (a trade mark). Invar is a relatively heavy material and when filters are used in satellite communication systems, the use of filters made from lighter materials is highly preferred. However, lighter materials, for example, aluminum, have a significantly higher coefficient of thermal expansion than Invar does. Therefore, lighter materials cannot reasonably be used for filters in satellite communication systems unless the change of center frequency can be reduced or eliminated by a temperature compensation device. While several temperature compensation devices are known, all of the previous devices have resulted in an increase in the insertion loss of the filter with which the device is used. When insertion loss of the filter increases, the transmitted power of the filter is reduced and the temperature of the filter is increased. Sometimes, it is desirable to change a center frequency of a filter without compensating for temperature changes.

SUMMARY OF THE INVENTION

It is an object of the present invention to provide a microwave filter containing a device for changing an operating frequency of the waveguide filter in a cavity wall of at least one cavity, said pocket moving further into said cavity to decrease said operating frequency and moving further out of said cavity to increase said operating frequency. It is a further object of the invention to provide a collapsible pocket in a cavity wall of a waveguide cavity to adjust an operating frequency of the filter in which the cavity is located where an interior of said pocket is sealed from an interior of said cavity.

It is still a further object of the present invention to provide a device for changing the operating frequency of a filter, whether or not the change is in response to temperature changes, where the device does not introduce a significantly lossy mechanism into the filter.

A device for changing an operating frequency of a microwave filter has at least one cavity with a cavity wall, said device having a collapsible pocket located in said cavity wall. The pocket extends into said at least one cavity and contains at least an inner end of an elongated member. The elongated member has an opposite end connected to activation means. An interior of the pocket is sealed from said at least one cavity, said activation means moving said elongated member and therefore said pocket further into said at least one cavity to decrease said operating frequency of said at least one cavity. The pocket has a rest position with means to remove a force from said activation means on said elongated member when said pocket is in an extended position, causing said pocket to retract to said rest position and causing an operating frequency of said at least one cavity to increase. The change in operating frequency of said at least one cavity results in a change of operating frequency of said filter.

A device for changing an operating frequency of said microwave filter has at least one cavity with a cavity wall, said device comprising a collapsible pocket located in said cavity wall. The pocket extends into said at least one cavity and an interior of said pocket is connected to an inner end of an elongated member. The elongated member has an opposite end connected to activation means. The interior of said pocket is sealed from an interior of said at least one cavity. The activation means moves said elongated member further into said cavity to decrease said operating frequency of said at least one cavity. The activation means moves said elongated member further out of said cavity to increase said operating frequency of said at least one cavity. The change in operating frequency of said at least one cavity results in a change in operating frequency of said filter.

A temperature compensation microwave filter has at least one cavity resonating at its resonant frequency, said at least one cavity having a cavity wall and containing in said cavity wall, one collapsible pocket primarily located for each mode of said cavity. Each pocket extends into said at least one cavity. An interior of each collapsible pocket is connected to one end of an elongated member, each elongated member being sealed from an interior of said at least one cavity.

Each elongated member has an opposite end connected to temperature compensation means. Each temperature compensation means moves said elongated member further into said cavity to extend said pocket as temperature decreases and further out of said cavity to retract said elongated member and therefore said pocket as temperature increases, thereby at least reducing a frequency change in said at least one cavity for the mode for which said pocket is primarily located.

DESCRIPTION OF A PREFERRED EMBODIMENT

Figure 1:
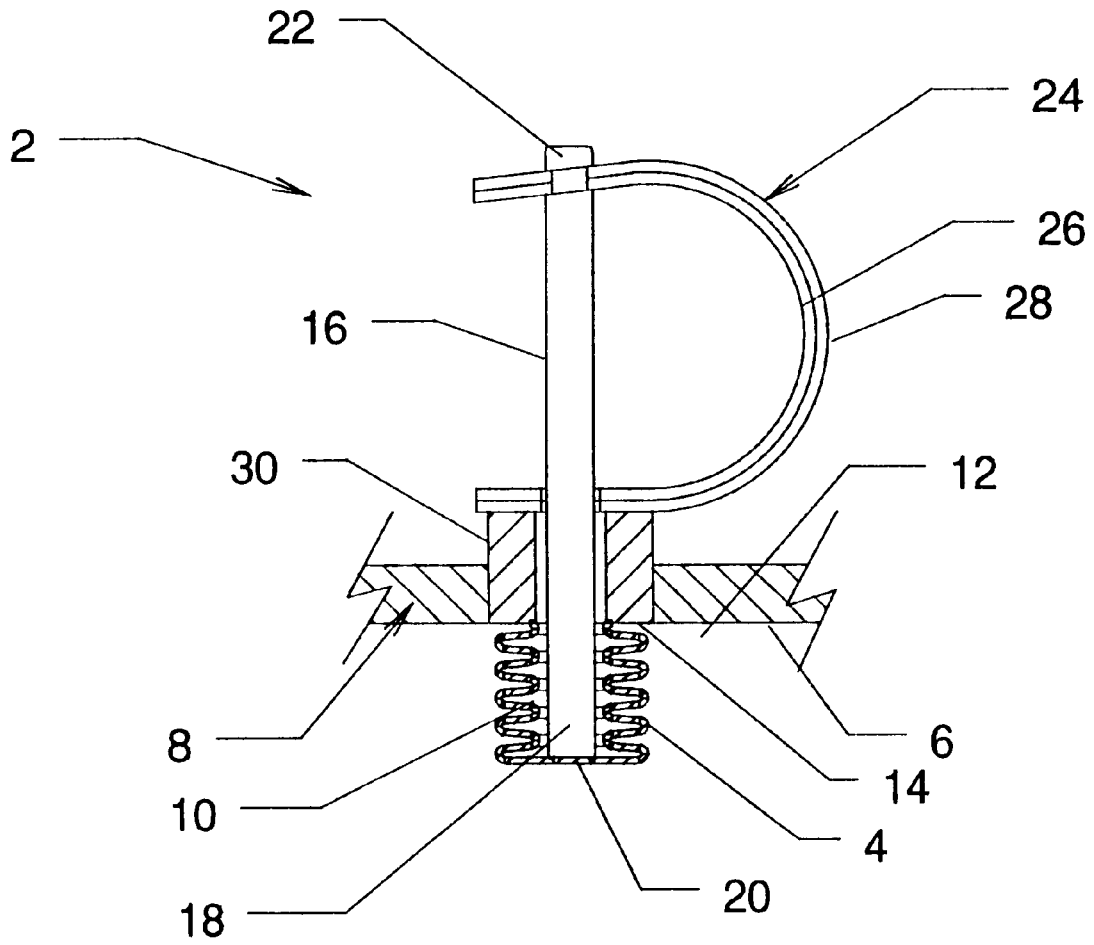
FIG. 1 is a sectional side view of a collapsible pocket connected to a bimetallic actuator where the pocket is in an extended position.

Referring to the drawings in greater detail, in FIG. 1, a device 2 for changing an operating frequency of a microwave filter has a pocket 4. The device 2 is mounted in a cavity wall 6 of a cavity 8 of a filter (not shown). The collapsible pocket 4 is a bellows. An interior 10 of the pocket 4 is sealed from an interior 12 of the cavity 8 by a seal 14 that is conductive and is preferably welded or soldered in place. An elongated member 16 has an inner end 18 that bears against an inner end 20 of the pocket 4. An outer end 22 of the elongated member 16 is connected to a bimetallic actuator 24. The actuator has two metallic strips 26, 28 that are formed in a general U-shape as shown. A collar 30 surrounds the elongated member 16 as said elongated member passes through an opening (not shown) in the cavity wall 6.

The inner strip 26 has a greater coefficient of thermal expansion than the outer strip 28 so that as temperature decreases, the elongated member 16 and therefore the pocket 4 moves further into the cavity 8 and the pocket is in an extended position as shown in FIG. 1.

Figure 2:
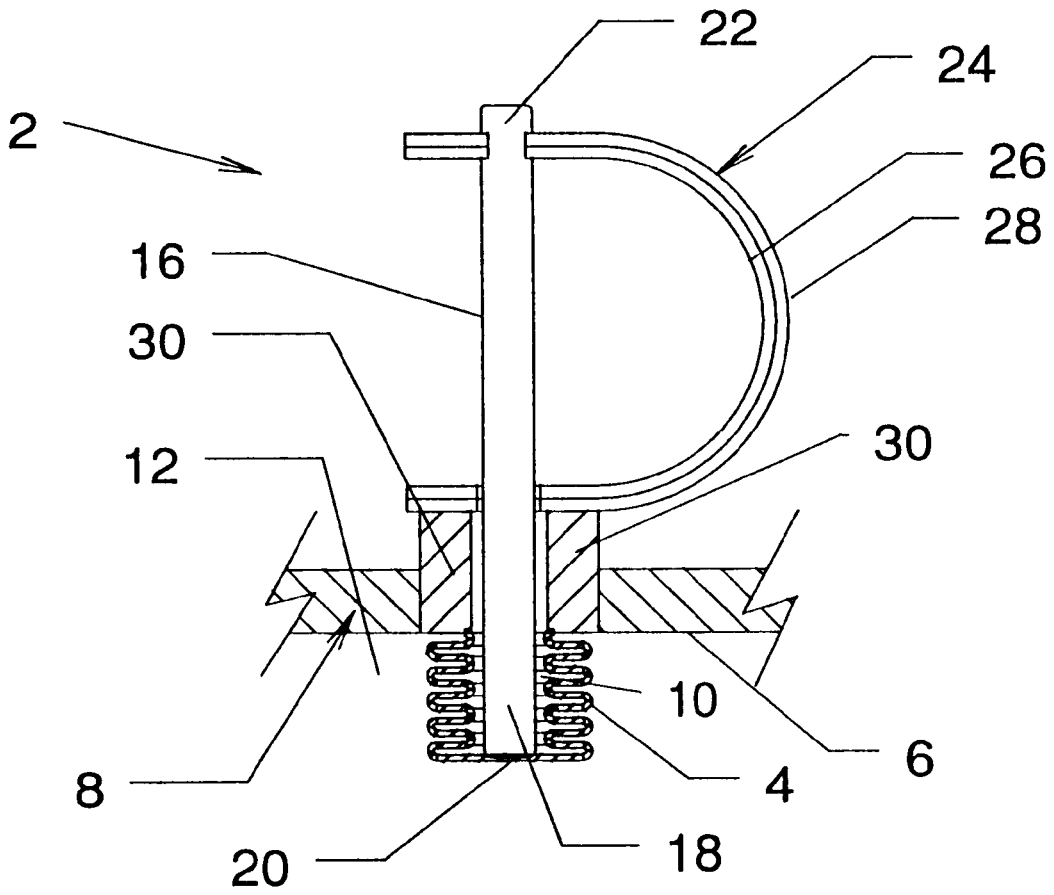
FIG. 2 is a sectional side view of the collapsible pocket of FIG. 1 in a retracted position.

In FIG. 2, the components are identical to those of FIG. 1 and the same reference numerals are used. As temperature increases, the bimetallic actuator 24 moves the elongated member 16 further out of the cavity 8 until the pocket 4 is in a retracted position as shown. The inner end 18 of the elongated member 16 can be affixed to the inner end 20 of the pocket 4 so that the pocket will move further into or further out of the cavity as the elongated member moves further into or further out of the cavity respectively. Alternatively, the inner end 18 of the elongated member 16 can be left unattached to the inner end 20 of the pocket 4. When this arrangement is utilized, the pocket will move further into the cavity as the elongated member moves further into the cavity but as the elongated member moves further out of the cavity, the force of the elongated member on the inner end of the pocket will be removed. The inner end of the pocket will then move to the retracted position as long as the elongated member does not prevent the movement of the pocket, which will then be a rest position for the pocket due to the inherent spring of the pocket. Preferably, the pocket is a bellows that is made from metallic material selected from the group of metal, plastic, Invar or aluminum. The bellows can be coated with a highly conductive material, for example, silver or gold. Silver is preferred over gold as silver has a higher conductivity. When a coating is used, the bellows themselves can be made from metallic material or plastic material or any other material to which the highly conductive coating will adhere. When the force of the elongated member is moved from the pocket, after the pocket has been extended, the pocket will return automatically to the rest position.

Figure 3:
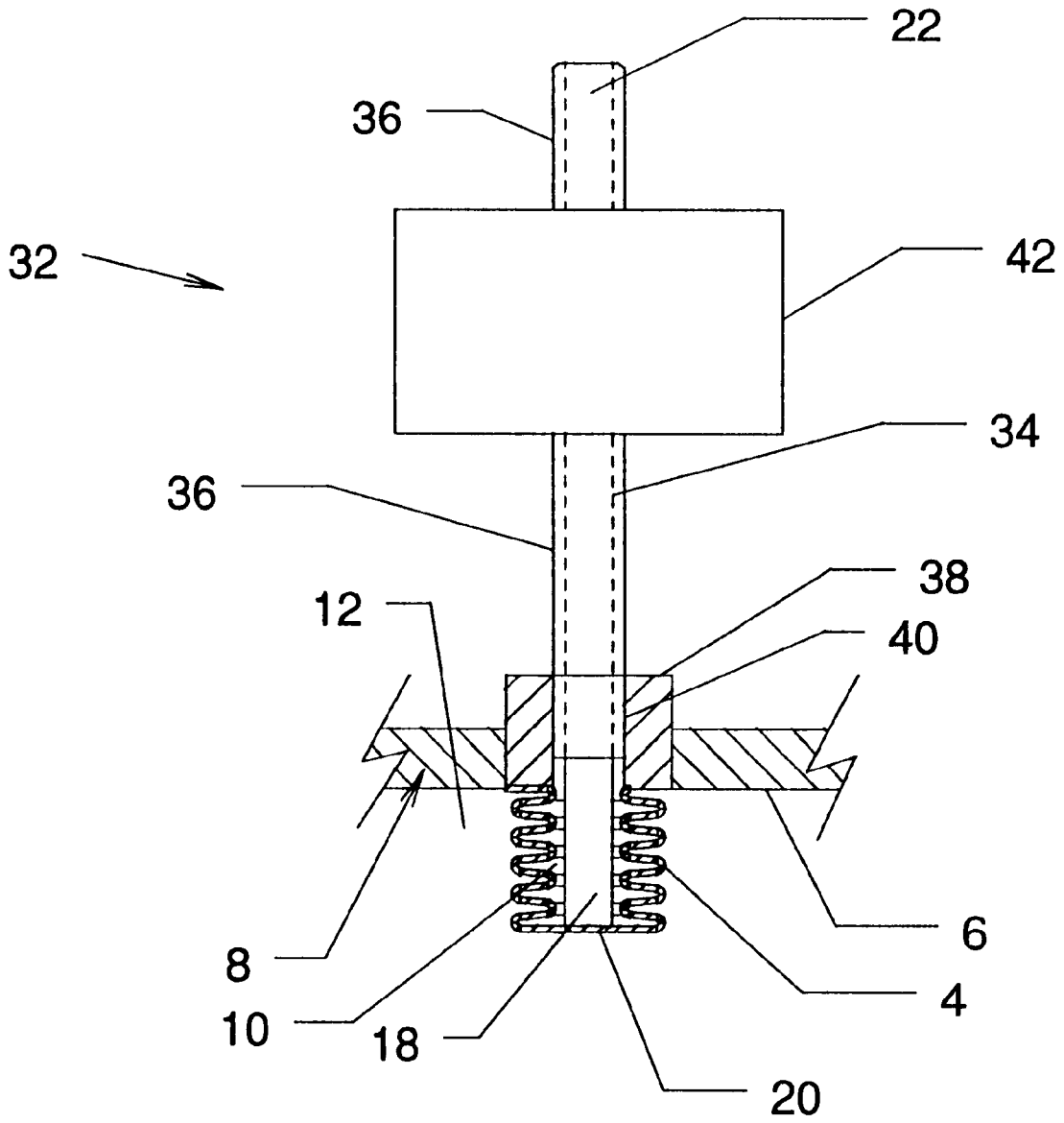
FIG. 3 is a sectional side view of a collapsible pocket mounted in a cavity wall with a rotary actuator and the pocket in an extended position.

In FIG. 3, those components that are identical to the components of FIGS. 1 and 2 are described using the same reference numerals. A device 32 has an elongated member 34 with a screw thread 36 (shown schematically) on its outer surface while a collar 38 has a corresponding screw thread 40 (shown schematically) on its inner surface. An outer end 22 of the elongated member 32 extends through a rotary actuator 42. The rotary actuator 42 rotates the screw about its longitudinal axis in one direction to move the elongated member and therefore the pocket 4 further into the cavity 8 to an extended position and in an opposite direction to move the elongated member further out of the cavity 8. The pocket 4 then moves with the elongated member if the inner end 18 of the elongated member is affixed to the inner end 20 of the pocket to the retracted position. As with the device 2, if the inner end 18 is not affixed to the inner end 20 of the pocket, the pocket will return toward the retracted position by its inherent spring as the elongated member moves out of the cavity 8.

Figure 4:
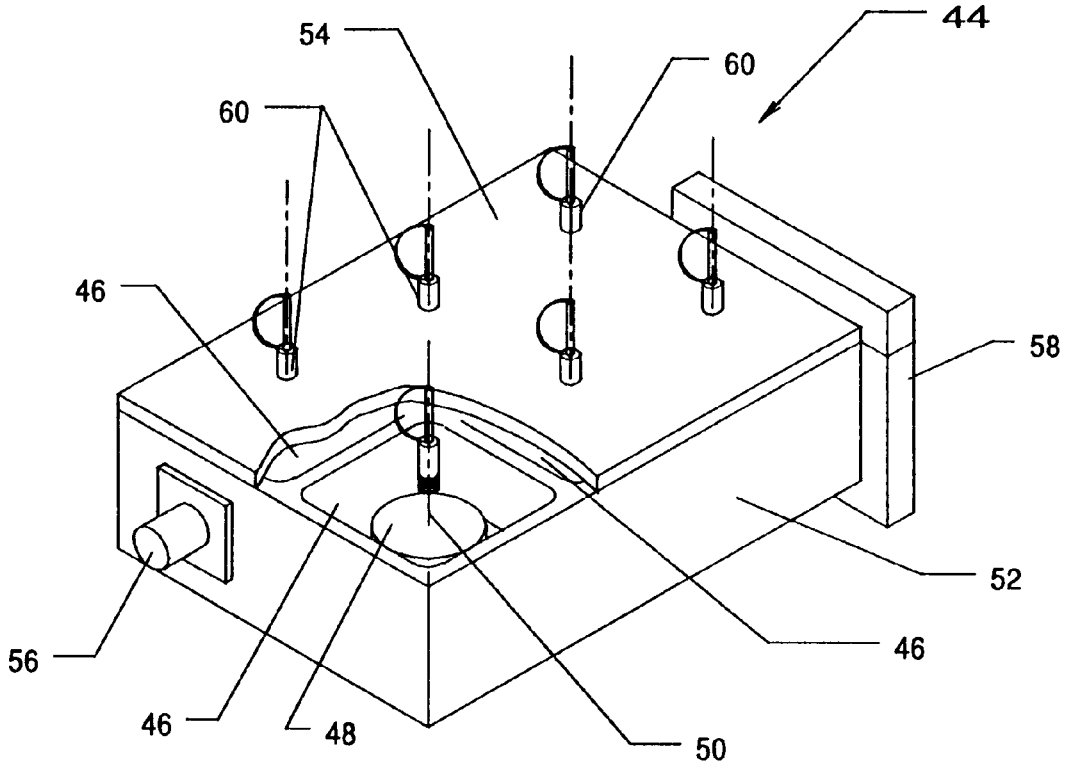
FIG. 4 is a perspective view of a six-pole single mode dielectrically loaded cavity filter with a cover partially cut away.

In FIG. 4, there is shown a six-pole single mode dielectrically loaded planar filter 44 containing six cavities 46 (only one of which is shown fully). Each of the cavities 46 contains a dielectric resonator 48 having a longitudinal center axis 50. The cavities 46 are formed in a housing 52 having a cover 54 with an input 56 and an output 58. Each cavity has a device 60 for changing an operating frequency of that cavity in which the device is located and therefore of changing the operating frequency of the filter 44. The devices 60 extend through the cover 54 along the longitudinal center axis 50 of each resonator 48 (only one of which is shown). While the device 60 is a schematic of the device 2 of FIGS. 1 and 2, other types of devices such as the device 42 of FIG. 3 could be used.

The device 2 of FIGS. 1 and 2 is, of course, temperature dependent. As temperature of the filter 44 increases, the bimetallic actuator will retract the elongated member and therefore the pocket will retract further out of said cavity to reduce a frequency change in the cavity for that change in temperature. Further, as temperature decreases, the bimetallic actuator will move the elongated member further into said cavity to extend the pocket, thereby reducing the change in operating frequency that would otherwise occur with that change in temperature. Virtually any materials that have a sufficient difference in coefficient of thermal expansion can be used for the bimetallic actuator. While metals will usually be chosen, in appropriate circumstances materials other than metals can be utilized or metallic material could be used with a non-metallic material to make up the bimetallic actuator.

Figure 5:
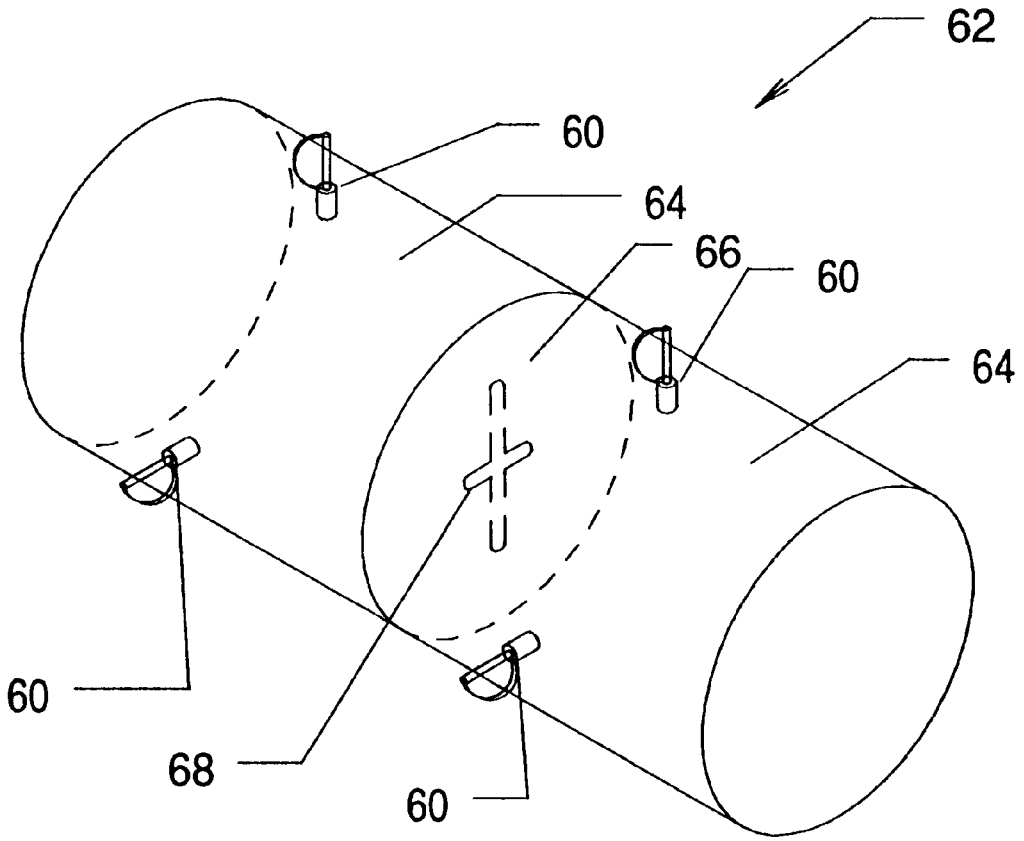
FIG. 5 is a schematic perspective view of a four-pole dual mode waveguide filter having two devices for changing the frequency in each cavity.

In FIG. 5, a four-pole dual mode filter 62 has two waveguide cavities 64. The filter 62 will have an input and output, tuning and coupling screws but these are not shown for purposes of simplicity. Energy is coupled between the cavities through an aperture 66 in an iris 68. The cavities 64 can contain dielectric resonators (not shown). Each cavity has a device 60 located primarily for each mode by changing an operating frequency of each cavity and therefore of the filter as a whole. The devices 60 can be operated by changes in temperature such as the devices 2 of FIGS. 1 and 2 or they can be independent of changes in temperature such as the device 32 of FIG. 3. The devices 60 operate in the same way for the filter 62 as they do for the filter 44.

The two filters shown in FIGS. 4 and 5 are examples of filters with which the device of the present invention can be used. The device can be used with virtually any filter where it is desired to change the operating frequency of the filter.

Preferably, there is at least one device for each mode of the filter in each cavity of a typical microwave filter. Still more preferably, these devices are mounted in a position of maximum field for the mode being compensated.

Numerous actuators will be suitable for moving the elongated member and therefore the pocket further into or further out of the cavity. The actuators can be temperature dependent or they can be electromechanical or mechanical. Preferably, the actuator will be such that the pocket can be moved over a broad range of distances further into or further out of the cavity.

I claim:

1. A device for changing an operating frequency of a microwave filter having at least one cavity with a cavity wall, said device comprising a collapsible pocket located in said cavity wall, said pocket extending into said at least one cavity, said pocket containing at least an inner end of an elongated member, said elongated member having an opposite end connected to a bimetallic actuator, an interior of said pocket being sealed from an interior of said at least one cavity, said bimetallic actuator moving said elongated member and therefore said pocket further into or out of said at least one cavity to decrease or increase respectively said operating frequency of said at least one cavity with changes in temperature, said pocket having a rest position, with means to remove a force from said bimetallic actuator on said elongated member when said pocket is in an extended position, causing said pocket to retract to said rest position and causing an operating frequency of said at least one cavity to increase, said change in operating frequency of said at least one cavity resulting in a change of operating frequency of said filter, there being one collapsible pocket primarily located for each mode of said at least one cavity, and an interior of said pocket being sealed from an interior of said at least one cavity.

2. A device as claimed in claim 1 wherein an interior of each pocket contains an elongated member connected to said bimetallic actuator.

3. A device as claimed in claim 2 wherein the pocket is a bellows that has a retracted position and a broad range of extended positions.

4. A device as claimed in claim 3 wherein the bellows is made from metallic material.

5. A device as claimed in claim 1 wherein the bimetallic actuator is constructed to move the elongated member further into said pocket and therefore further into said at least one cavity to extend said pocket as temperature decreases and further out of said pocket to retract said pocket as temperature increases.

6. A device as claimed in claim 5 wherein the inner end of said elongated member is connected to said interior of said pocket.

7. A device as claimed in any one of claims 1, 2 or 3 wherein the pocket is coated with a highly conductive material.

8. A device as claimed in any one of claims 1, 2 or 3 wherein the pocket is coated with a highly conductive material selected from the group of gold and silver.

9. A device as claimed in any one of claims 2, 3 or 4 wherein the filter has more than one cavity.

10. A device as claimed in any one of claims 2, 3 or 4 wherein the filter has more than one cavity and each cavity has a device for changing an operating frequency of that cavity.

11. A device for changing an operating frequency of a microwave filter having at least one cavity with a cavity wall, said device comprising a collapsible pocket located in said cavity wall, said pocket extending into said at least one cavity, an inner end of an elongated member contacting an interior of said pocket, said elongated member having an opposite end connected to a bimetallic actuator, said interior of said pocket being sealed from an interior of said at least one cavity, said bimetallic actuator moving said elongated member further into said cavity to decrease said operating frequency of said at least one cavity, said bimetallic actuator moving said elongated member further out of or into said cavity to increase or decrease respectively said operating frequency of said at least one cavity, said change in operating frequency of said at least one cavity resulting in a change in operating frequency of said filter.

12. A device as claimed in claim 11 wherein the inner end of the elongated member is connected to said interior of said pocket.

13. A device as claimed in claim 12 wherein the pocket is a bellows that has a retracted position and a broad range of extended positions.

14. A device as claimed in claim 13 wherein the bellows is made from metallic material.

15. A device as claimed in claim 13 wherein the bimetallic actuator moves the elongated member further into said pocket and therefore further into said at least one cavity to extend said pocket as temperature decreases and further out of said pocket to retract said pocket as temperature increases.

16. A device as claimed in any one of claims 11, 12 or 13 wherein the pocket is made from metallic material selected from the group of silver and gold.

17. A device as claimed in any one of claims 11, 12 or 13 wherein the pocket is coated with a highly conductive material.

18. A temperature compensation microwave filter having at least one cavity resonating at its resonant frequency, said at least one cavity having a cavity wall and containing:

(a) in said cavity wall, one collapsible pocket primarily located for each mode of said cavity, each pocket extending into said at least one cavity;

(b) an interior of each collapsible pocket being connected to one end of an elongated member, an interior of each pocket being sealed from an interior of said at least one cavity, each elongated member having an opposite end connected to a bimetallic actuator;

(c) each bimetallic actuator moving said elongated member further into said cavity to extend said pocket as temperature decreases and further out of said cavity to retract said elongated member and therefore said pocket as temperature increases, thereby at least reducing a frequency change in said at least one cavity for the mode for which said pocket is primarily located.

19. A filter as claimed in claim 18 wherein the bimetallic actuator is a bimetallic strip connected to said elongated member.

20. A filter as claimed in claim 19 wherein said bimetallic strip has two layers of material with each layer having a different coefficient of thermal expansion.

21. A filter as claimed in any one of claims 18, 19 or 20 wherein the pocket is a bellows that has a retracted position and a broad range of extended positions.

22. A filter as claimed in any one of claims 18, 19 or 20 wherein the filter has at least two cavities resonating in a dual mode.

23. A filter as claimed in any one of claims 18, 19 or 20 wherein the filter has at least four single mode cavities.

24. A filter as claimed in any one of claims 18, 19 or 20 wherein the filter is a planar filter.

25. A filter as claimed in any one of claims 18, 19 or 20 wherein the filter is a waveguide filter.

* * * * *